US011181031B2

(12) United States Patent
Hamashima et al.

(10) Patent No.: US 11,181,031 B2
(45) Date of Patent: Nov. 23, 2021

(54) MUFFLER

(71) Applicant: HONDA MOTOR CO., LTD., Tokyo (JP)

(72) Inventors: Hidenori Hamashima, Wako (JP); Hiroaki Nakanishi, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 497 days.

(21) Appl. No.: 16/161,481

(22) Filed: Oct. 16, 2018

(65) Prior Publication Data

US 2019/0120116 A1 Apr. 25, 2019

(30) Foreign Application Priority Data

Oct. 19, 2017 (JP) ..... JP2017-202775

(51) Int. Cl.

| | |
|---|---|
| ***F01N 13/08*** | (2010.01) |
| *F01N 13/18* | (2010.01) |
| *F01N 3/28* | (2006.01) |
| *F01N 1/24* | (2006.01) |
| *F01N 1/08* | (2006.01) |
| *F01N 1/02* | (2006.01) |

(52) U.S. Cl.

CPC ..... *F01N 13/08* (2013.01); *F01N 1/02* (2013.01); *F01N 1/084* (2013.01); *F01N 1/24* (2013.01); *F01N 3/2885* (2013.01); *F01N 13/1877* (2013.01); *F01N 2210/04* (2013.01); *F01N 2240/20* (2013.01); *F01N 2470/02* (2013.01)

(58) Field of Classification Search

CPC ..... F01N 1/087; F01N 1/088; F01N 13/08; F01N 2240/20; F01N 2490/08

See application file for complete search history.

(56) References Cited

U.S. PATENT DOCUMENTS

| | | | | |
|---|---|---|---|---|
| 4,595,073 | A * | 6/1986 | Thawani | F01N 1/08 181/265 |
| 5,959,263 | A * | 9/1999 | Foltz, Jr. | F01N 1/084 181/254 |
| 6,588,545 | B1 * | 7/2003 | Lee | F01N 3/02 181/264 |
| 2006/0243521 | A1 * | 11/2006 | Price | F01N 1/083 181/248 |

FOREIGN PATENT DOCUMENTS

| | | |
|---|---|---|
| JP | 2007-016753 A | 1/2007 |
| JP | 2009-127475 A | 6/2009 |
| JP | 4553320 B2 | 9/2010 |
| JP | 2014-141927 A | 8/2014 |

OTHER PUBLICATIONS

Office Action dated Jan. 29, 2019 issued over the corresponding Japanese Patent Application No. 2017-202775 with the English translation of pertinent portion.

* cited by examiner

*Primary Examiner* — Jonathan R Matthias

(74) *Attorney, Agent, or Firm* — Carrier Blackman & Associates, P.C.; Joseph P. Carrier; William D. Blackman

(57) ABSTRACT

A muffler, connected to an engine through an exhaust pipe, includes a shell serving as a muffler body, an inlet pipe configured to introduce exhaust gas from the engine into the shell, an outlet pipe configured to discharge the exhaust gas out of the shell, and a cap configured to be attached to a narrowed portion of the inlet pipe and control the direction in which the exhaust gas flows out. The cap is provided with an opening through which the exhaust gas passes and which regulates the direction in which the exhaust gas flows out.

8 Claims, 8 Drawing Sheets

FIG. 4A EMBODIMENT
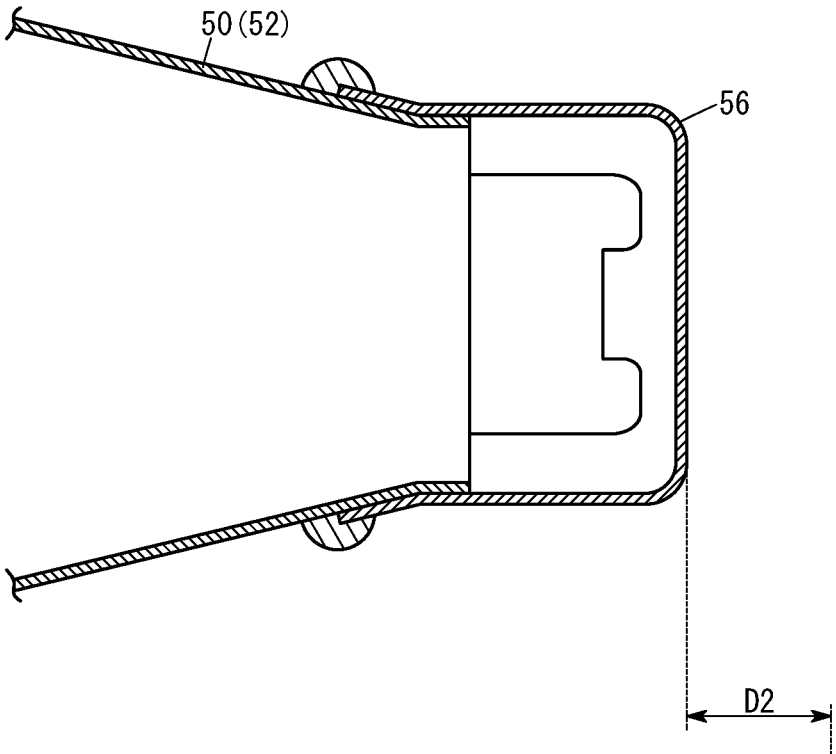
FIG. 4B COMPARATIVE EXAMPLE
PRIOR ART
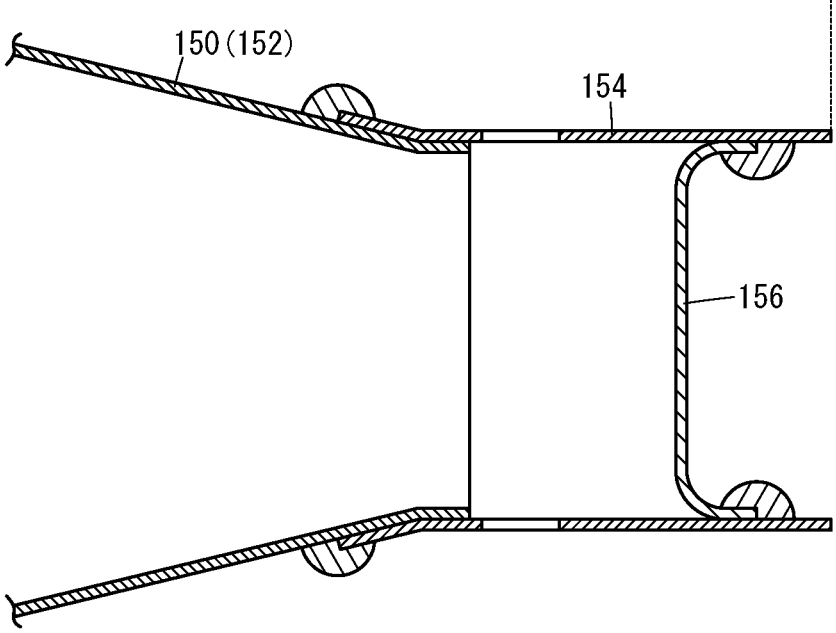

FIG. 5A EMBODIMENT
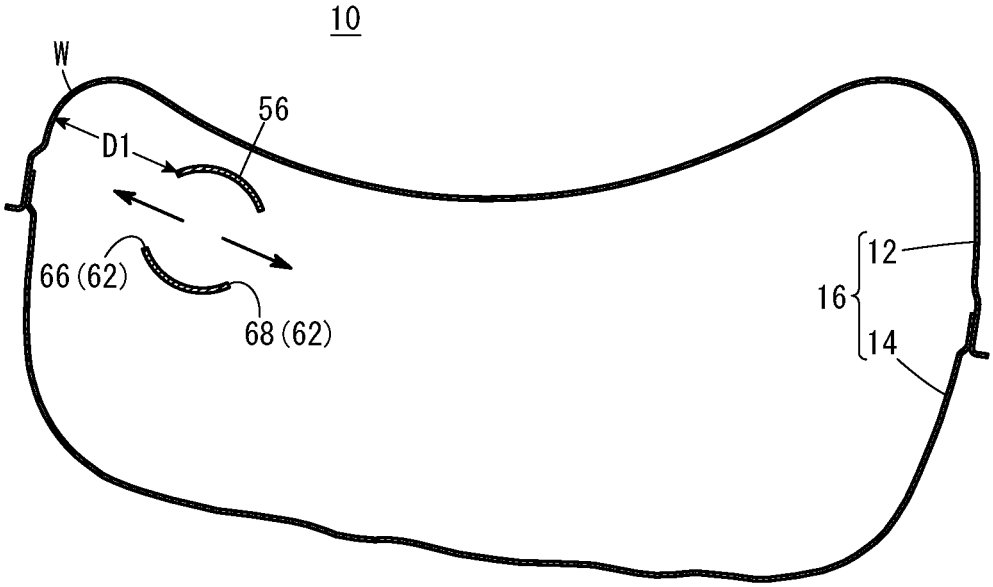
FIG. 5B COMPARATIVE EXAMPLE
PRIOR ART
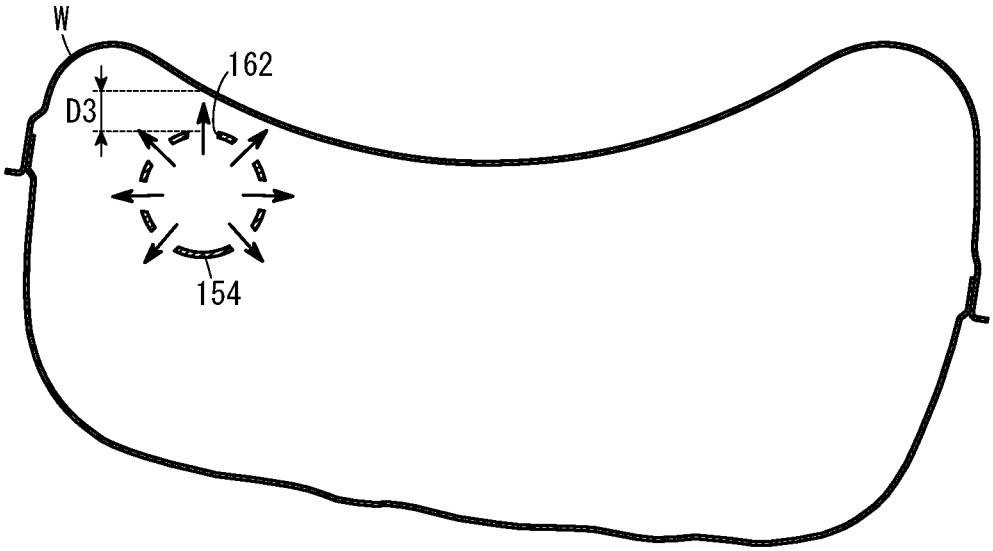

MUFFLER

CROSS-REFERENCE TO RELATED APPLICATION

This application is based upon and claims the benefit of priority from Japanese Patent Application No. 2017-202775 filed on Oct. 19, 2017, the contents of which are incorporated herein by reference.

BACKGROUND OF THE INVENTION

Field of the Invention:

The present invention relates to a muffler.

Description of the Related Art:

As illustrated in FIG. 7, a muffler 5 disclosed in Japanese Laid-Open Patent Publication No. 2007-016753 includes a shell 1 formed of steel sheets serving as a muffler body, a plurality of separators 2 sectioning the inside of the shell 1 into chambers such as an expansion chamber and a resonance chamber, an inlet pipe 3 introducing exhaust gas into the shell 1, and an outlet pipe 4 discharging the exhaust gas to the outside of the shell 1.

In the muffler 5, high-temperature exhaust gas discharged from the inlet pipe 3 comes into direct contact with the inner wall of the shell 1 and causes the temperature of the part receiving the exhaust gas to be elevated. This often causes discoloration (hereinafter also referred to as partial burns) of the outer wall (surface) of the shell 1. Such discoloration (partial burns) of the shell 1 causes unevenness in color and degrades the appearance of the muffler 5. This is a drawback of the muffler 5 disclosed in Japanese Laid-Open Patent Publication No. 2007-016753.

To date, various mufflers in which such discoloration of shells is avoided have been proposed. For example, as illustrated in FIG. 8, a muffler 8 disclosed in Japanese Patent No. 4553320 includes an inlet pipe 6 of which the downstream end is bent toward the outer circumferential surface of an outlet pipe 7. According to the description, because exhaust gas discharged from the inlet pipe 6 comes into contact with the outer circumferential surface of the outlet pipe 7 without coming into direct contact with a shell 9, discoloration of the shell 9 due to uneven burns is thus prevented.

In addition, Japanese Laid-Open Patent Publication No. 2014-141927 discloses a technique in which a downstream end of an inlet pipe is closed with a cap. Exhaust gas is introduced to a resonance chamber through punched holes provided for the circumferential surface of the inlet pipe.

SUMMARY OF THE INVENTION

The muffler 8 disclosed in Japanese Patent No. 4553320 requires the inlet pipe 6 with the bent downstream end, that is, the inlet pipe 6 with a long entire length. This causes an increase in the weight and production costs of the inlet pipe 6.

The present invention has been devised taking into consideration the aforementioned problems, and has the object of providing a muffler reduced in size, weight, and costs while discoloration (partial burns) of a shell is reliably prevented.

The muffler according to the present invention, connected to an engine through an exhaust pipe, includes a shell serving as a muffler body, an inlet pipe configured to introduce exhaust gas from the engine into the shell, an outlet pipe configured to discharge the exhaust gas out of the shell, and a cap configured to be attached to a downstream-side open end of the inlet pipe and control the direction in which the exhaust gas flows out. The cap is provided with an opening through which the exhaust gas passes and which regulates the direction in which the exhaust gas flows out.

According to the present invention, attaching the cap to the downstream-side end of the inlet pipe to orient the opening in a desired direction enables the direction in which the exhaust gas flows out to be regulated according to the shape of the shell and the arrangement of the inlet pipe. This facilitates reduction in size, weight, and cost compared with the above-described known technologies and reliably prevents discoloration (partial burns) of the shell.

In the present invention, the cap may include a sidewall portion, attached to the downstream-side open end of the inlet pipe and extending downstream in an axial direction of the inlet pipe, and a bottom wall portion configured to block a flow of the exhaust gas flowing out of the downstream-side open end of the inlet pipe at a downstream-side end of the sidewall portion. The opening may be provided for the sidewall portion.

According to this structure, the exhaust gas flowing out of the downstream-side open end of the inlet pipe is blocked by the bottom wall portion and flows out of the opening of the sidewall portion into the shell. This reliably prevents discoloration (partial burns) of a part of an inner wall of the shell located in the direction from the downstream side of the inlet pipe in the axial direction toward the bottom wall portion.

In the present invention, the sidewall portion may include a tapered portion the diameter of which increases toward the downstream-side open end of the inlet pipe.

According to this structure, the cap is also readily attached to the downstream-side end of the inlet pipe along the circumferential surface (tapered surface) of the downstream-side end in a case where the diameter of the downstream-side end of the inlet pipe is reduced according to the frequencies of exhaust-gas pulsation the removal of which is desired.

In the present invention, the opening may face in a direction that maximizes a distance from the inner wall of the shell opposite the opening.

This structure reliably prevents discoloration (partial burns) of the part of the inner wall of the shell opposite the opening.

In the present invention, the opening may face in a direction where a surface temperature of an outermost part of the shell is less than or equal to a predetermined value.

According to this structure, the direction in which the opening faces is set according to the relationship with the surface temperature of the outermost part of the shell. Thus, discoloration (partial burns) of the outermost part of the shell caused by the heat of the exhaust gas is reliably prevented.

According to the present invention, attaching the cap to the downstream-side end of the inlet pipe to orient the opening of the cap in a desired direction enables the direction in which the exhaust gas flows out to be regulated according to the shape of the shell and the arrangement of the inlet pipe. This facilitates reduction in size, weight, and cost compared with the above-described known technologies and reliably prevents discoloration (partial burns) of the shell.

The above and other objects features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 4A is a cross-sectional view of the downstream end of an inlet pipe illustrated in FIG. 2 taken along line IV-IV, and FIG. 4B is a cross-sectional view of the downstream end of an inlet pipe according to a known technology as a comparative example;

FIG. 5A is a cross-sectional view of the cap and a shell illustrated in FIG. 2 taken along line V-V, and FIG. 5B is a cross-sectional view of a cap and a shell according to the known technology as the comparative example;

DESCRIPTION OF THE PREFERRED EMBODIMENTS

A preferred embodiment of a muffler according to the present invention will be described in detail below with reference to the accompanying drawings. In the description below, the embodiment will be explained with reference to arrows indicating directions toward the front, rear, left, right, top, and bottom illustrated in FIG. 1.

1. Structure of Muffler 10

Figure 1:
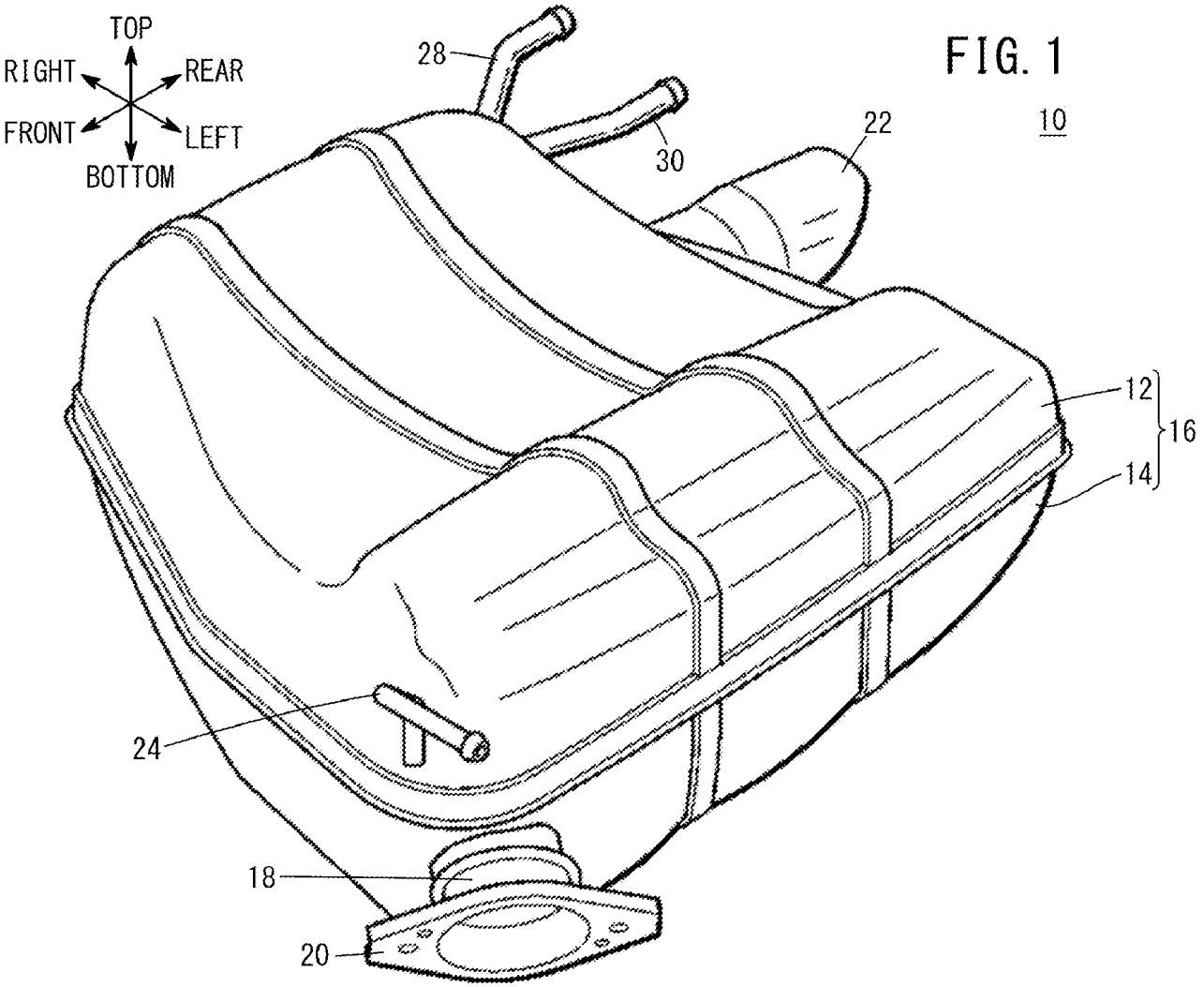
FIG. 1 is a perspective view of a muffler according to an embodiment.
Figure 2:
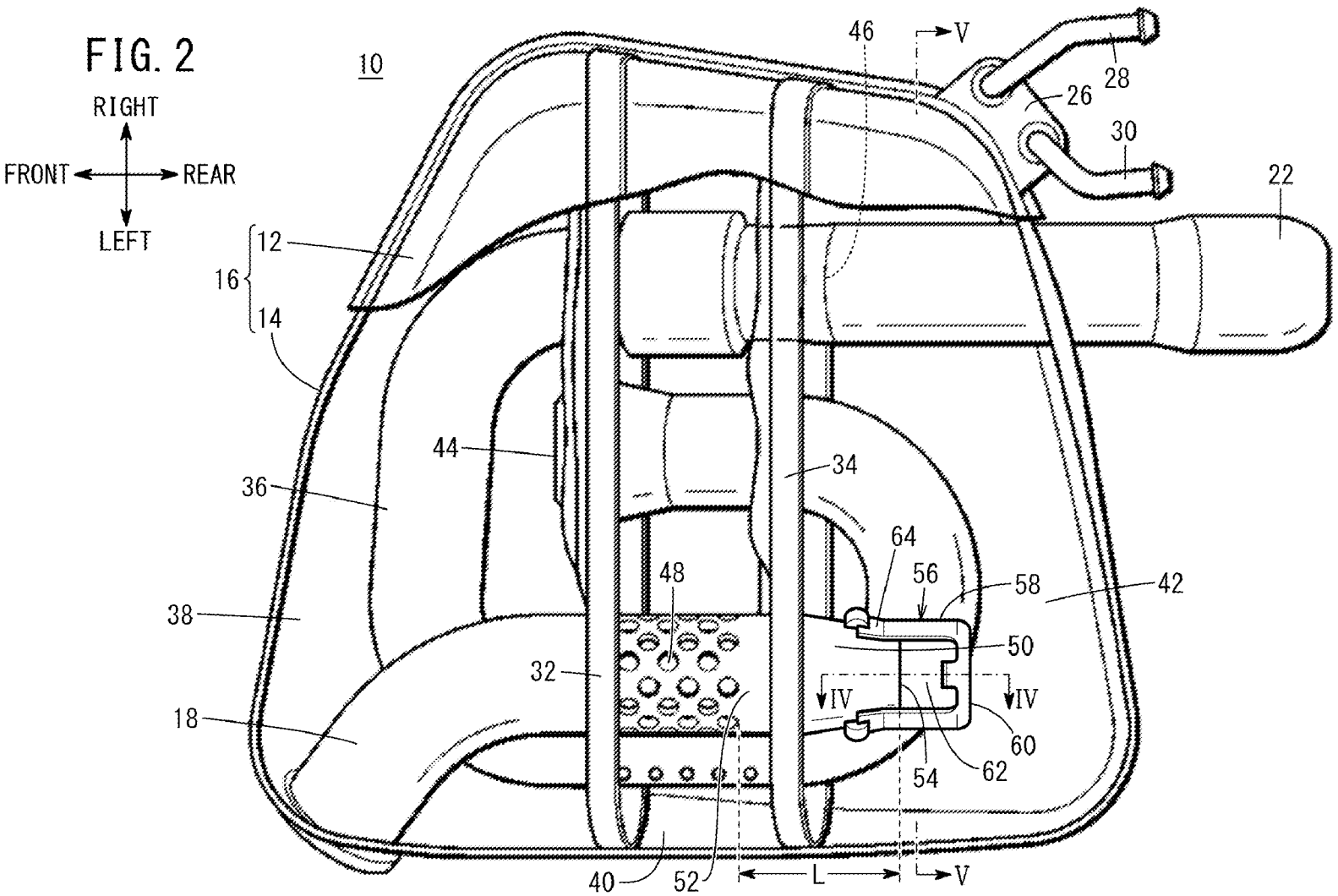
FIG. 2 is a plan view illustrating the internal structure of the muffler according to the embodiment.

As illustrated in FIG. 1, a muffler 10 includes a shell 16 made up of an upper shell half 12 and a lower shell half 14 shaped by stamping steel sheets and joined together, an inlet pipe 18 protruding obliquely forward from the left front end of the lower shell half 14, a connection flange 20 welded to an end of the inlet pipe 18, a tail pipe 22 protruding rearward from the right rear surface of the lower shell half 14, a front stay 24 welded to the left front end of the upper shell half 12, and a pair of right and left rear stays 28 and 30 welded to the right rear ends of the upper shell half 12 and the lower shell half 14 via a bracket 26 (see FIG. 2).

The muffler 10 is mounted on the bottom surface of the body of an automobile (not illustrated) via the front stay 24 and the rear stays 28 and 30.

As illustrated in FIG. 2, the shell 16 includes a first separator 32 and a second separator 34 sectioning the internal space of the shell 16 into a plurality of chambers, the inlet pipe 18 introducing exhaust gas into the inside of the shell 16 from the left front end of the lower shell half 14, and an outlet pipe 36 bending a plurality of times inside the shell 16 and discharging the exhaust gas to the outside through the tail pipe 22. The internal space of the shell 16 is sectioned by the first separator 32 and the second separator 34 into a first expansion chamber 38, a second expansion chamber 40, and a resonance chamber 42 arranged in this order from the front.

The inlet pipe 18 enters the shell 16 from the left front end of the lower shell half 14 and bends rearward inside the first expansion chamber 38. A downstream-side part of the inlet pipe 18 from the bending point extends further rearward and passes through the first separator 32 and the second separator 34. The downstream end of the inlet pipe 18 is located inside the resonance chamber 42.

The outlet pipe 36 has an opening in the upstream end 44 that opens inside the first expansion chamber 38, extends from the second expansion chamber 40 to the resonance chamber 42 toward the downstream end 46, and bends to form a substantially U shape in the resonance chamber 42. The outlet pipe 36 bending in the resonance chamber 42 extends from the second expansion chamber 40 to the first expansion chamber 38 and bends again to form a substantially U shape in the first expansion chamber 38. The downstream end 46 of the outlet pipe 36 is joined to the tail pipe 22 in the resonance chamber 42. More specifically, the outlet pipe 36 has a substantially spiral shape inside the shell 16.

The first separator 32 and the second separator 34 each have a plurality of holes (not illustrated) in which the inlet pipe 18 and the outlet pipe 36 are fitted, and support the inlet pipe 18 and the outlet pipe 36 inside the shell 16.

The first separator 32 and the second separator 34 has small holes (not illustrated) to circulate exhaust gas and condensate between the first expansion chamber 38 and the second expansion chamber 40 and between the second expansion chamber 40 and the resonance chamber 42. In this embodiment, the first separator 32 has a large number of small holes, and thus the first expansion chamber 38 and the second expansion chamber 40 substantially function as one expansion chamber.

2. Structure of Downstream End of Inlet Pipe 18

Next, the structure of a downstream part of the inlet pipe 18 inside the shell 16 will be described with reference to FIGS. 2, 3, 4A and 5A.

The inlet pipe 18 has a plurality of punched holes 48 that communicate with the second expansion chamber 40, in the circumferential surface between the first separator 32 and the second separator 34. The inlet pipe 18 further includes, on the downstream side of the inlet pipe 18 from the second separator 34, a narrowed portion 50 the diameter of which gradually decreases toward the distal end.

Note that a part of the inlet pipe 18 located on a further downstream side from the most downstream side punched holes 48—that is, a part that includes the narrowed portion 50 but does not have the punched holes 48 made—corresponds to the neck of a Helmholtz resonator. In FIG. 2, reference sign 52 indicates the neck of the inlet pipe 18, and reference sign L indicates the length of the neck 52 (neck length L).

The narrowed portion 50 is hollow and has a truncated cone shape. The narrowed portion 50 is provided with an exhaust outlet 54 that opens rearward at the most downstream end of the narrowed portion 50, and a cap 56 is attached to the most downstream end of the narrowed portion 50 to control the direction in which the exhaust gas flows out of the exhaust outlet 54.

Figure 3:
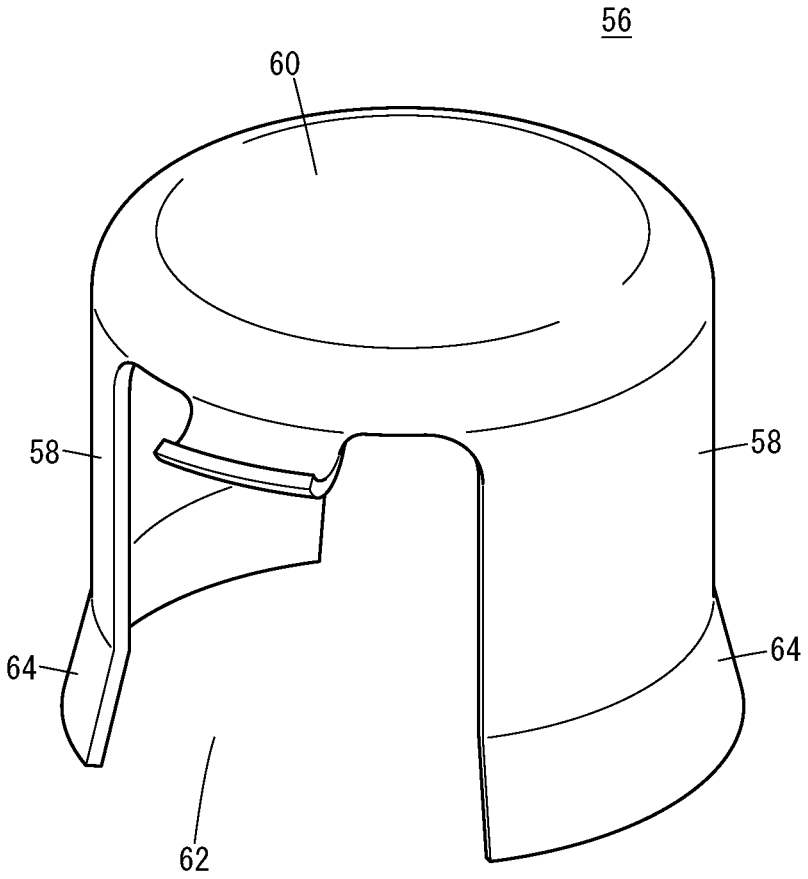
FIG. 3 is a perspective view of a cap.

As illustrated in FIG. 3, the cap 56 includes a sidewall portion 58 that is attached to the circumferential surface of the narrowed portion 50 and extends downward in the axial direction of the narrowed portion 50, and a bottom wall portion 60 blocking the flow of the exhaust gas flowing out of the exhaust outlet 54 at the downstream end of the sidewall portion 58 to change the direction in which the exhaust gas flows out. The sidewall portion 58 is provided with openings 62 that allow the exhaust gas to pass therethrough and flow out of the exhaust outlet 54 to regulate the direction in which the exhaust gas flows out.

The bottom wall portion 60 has a substantially disk shape having a diameter larger than the diameter of the exhaust outlet 54. The sidewall portion 58 is a curved wall (substantially cylindrical sidewall) standing from the outer edge of the bottom wall portion 60. That is, taken altogether, the cap 56 is a bottomed cylindrical member of which one end in the axial direction on the exhaust outlet 54 side opens and the other end in the axial direction is closed. More specifically, the cap 56 is a bottomed cylindrical member that has, in the sidewall portion 58 serving as the circumferential surface, the openings 62 formed by cutting out part of the sidewall portion 58 ranging from the distal end of the sidewall portion 58 to the bottom wall portion 60.

The sidewall portion 58 includes, at the end facing the exhaust outlet 54, a tapered portion 64 the diameter of which increases toward the exhaust outlet 54. As illustrated in FIG. 3, the tapered portion 64 is tapered at a predetermined angle corresponding to the degree of reduction in the diameter of the narrowed portion 50 of the inlet pipe 18 to come into contact with the outer circumferential surface of the narrowed portion 50 without space.

As illustrated in FIG. 5A, the cap 56 has two openings 62 (a first opening 66 and a second opening 68) arranged to be point-symmetric with respect to the axis of the cap 56 as the center of symmetry. Here, when the cap 56 is attached to the narrowed portion 50, the opening 62 closer to the inner wall of the shell 16 is defined as the first opening 66, and the opening 62 farther from the inner wall of the shell 16 is defined as the second opening 68.

In this embodiment, the cap 56 is attached to the outer circumferential surface of the narrowed portion 50 of the inlet pipe 18 by metal inert gas (MIG) welding. The cap 56 is attached to the narrowed portion 50 of the inlet pipe 18 in a manner so as to maximize the distance D1 between the first opening 66 and the inner wall W of the shell 16 opposite the first opening 66 (the inner wall W located in the normal direction of the first opening 66).

3. Effects of Muffler 10

Next, the flow of the exhaust gas in the muffler 10 will be described with reference to FIG. 2.

First, when an engine of an automobile (not illustrated) is started, exhaust gas generated in engine cylinders passes through an exhaust manifold, a catalytic converter, an exhaust pipe, and other components (all not illustrated), and then is introduced into the shell 16 of the muffler 10 through the inlet pipe 18 connected with the exhaust pipe.

The exhaust gas circulating in the inlet pipe 18 flows out into the second expansion chamber 40 through the punched holes 48. The exhaust gas then flows into the resonance chamber 42 through the exhaust outlet 54 of the neck 52 including the narrowed portion 50.

When the exhaust gas flows into the resonance chamber 42, the direction in which the exhaust gas flows out of the exhaust outlet 54 is controlled by the cap 56. In this case, the exhaust gas flowing out of the exhaust outlet 54 is blocked by the bottom wall portion 60 of the cap 56, and the direction in which the exhaust gas flows out is changed approximately by 90°. Then, the exhaust gas flows into the resonance chamber 42 through the openings 62 (the first opening 66 and the second opening 68) of the sidewall portion 58 while the direction in which the exhaust gas flows out is regulated by the openings 62 (the first opening 66 and the second opening 68).

More specifically, the exhaust gas flows out of the neck 52 with the neck length L (the downstream side of the inlet pipe 18 from the punched holes 48 with the narrowed portion 50 included) and flows through the exhaust outlet 54 into the resonance chamber 42 having a volume larger than the volume of the neck 52 with the neck length L while the direction in which the exhaust gas flows out is changed approximately by 90° by the bottom wall portion 60 and the openings 62. At this moment, sounds of the exhaust gas at predetermined frequencies are reduced inside the resonance chamber 42 due to the effect of resonance.

Furthermore, the exhaust gas flowing into the resonance chamber 42 and the second expansion chamber 40 is introduced into the first expansion chamber 38 through the small holes (not illustrated) bored in the first separator 32 and the second separator 34. The exhaust gas introduced into the first expansion chamber 38 flows into the outlet pipe 36 from the upstream end 44 and passes through the second expansion chamber 40, the resonance chamber 42, and the first expansion chamber 38 along the curves of the outlet pipe 36. The exhaust gas then flows into the tail pipe 22 and finally is discharged from the tail pipe 22 to the outside.

4. Summary of Embodiment

The muffler 10 according to this embodiment, connected to the engine (not illustrated) through the exhaust pipe, includes the shell 16 serving as a muffler body, the inlet pipe 18 configured to introduce exhaust gas from the engine into the shell 16, the outlet pipe 36 configured to discharge the exhaust gas to the outside of the shell 16, and the cap 56 attached to the narrowed portion 50 (the downstream open end) of the inlet pipe 18 to control the direction in which the exhaust gas flows out. The cap 56 is provided with the openings 62 (the first opening 66 and the second opening 68) through which the exhaust gas flows and which regulate the direction the exhaust gas flows out.

According to this structure, attaching the cap 56 to the narrowed portion 50 (the downstream-side open end) of the inlet pipe 18 with the openings 62 (the first opening 66 and the second opening 68) oriented in desired directions enables the direction in which the exhaust gas flows out to be regulated according to the shape of the shell 16, the arrangement of the inlet pipe 18, and the like. This facilitates reduction in size, weight, and cost compared with the above-described known technologies and reliably prevents discoloration (partial burns) of the shell 16.

The cap 56 may include the sidewall portion 58 that is attached to the circumferential surface of the narrowed portion 50 (the exhaust outlet 54 of the inlet pipe 18) and extends downstream in the axial direction of the narrowed portion 50 (inlet pipe 18), and the bottom wall portion 60 that blocks the flow of the exhaust gas discharged from the exhaust outlet 54 (the downstream-side open end of the inlet pipe 18) at the downstream-side end of the sidewall portion 58. The openings 62 (the first opening 66 and the second opening 68) may be provided for the sidewall portion 58.

According to this structure, the exhaust gas flowing out of the exhaust outlet 54 of the inlet pipe 18 is blocked by the bottom wall portion 60 and flows out of the openings 62 (the first opening 66 and the second opening 68) of the sidewall portion 58 into the resonance chamber 42 (the shell 16). Therefore, it is possible to reliably prevent discoloration (partial burns) of the part of the inner wall of the shell 16 located in the direction from the downstream side of the inlet pipe 18 in the axial direction toward the bottom wall portion 60.

The sidewall portion 58 may further include the tapered portion 64 the diameter of which increases toward the exhaust outlet 54 (the downstream-side open end) of the inlet pipe 18.

According to this structure, the cap 56 is also readily attached to the narrowed portion 50 (downstream-side end) of the inlet pipe 18 along the circumferential surface (tapered surface) of the narrowed portion 50 even in a case where the narrowed portion 50 is formed by reducing the diameter of the downstream-side end of the inlet pipe 18 according to the frequencies of exhaust-gas pulsation the removal of which is desired.

Furthermore, the first opening 66 may face in a direction that maximizes the distance D1 from the inner wall W of the shell 16 opposite the first opening 66.

This structure reliably prevents discoloration (partial burns) of the part of the inner wall W of the shell 16 opposite the first opening 66.

5. Comparison with Comparative Example

FIG. 4B is a cross-sectional view of the downstream-side end of an inlet pipe according to a known technology as a comparative example. In this comparative example, a pipe 154 is attached to the distal end of a neck 150 (a narrowed portion 152) of the inlet pipe, and a cap 156 is welded to the inside of the pipe 154. As illustrated in FIGS. 4A and 4B, the length of the cap 56 according to the embodiment of the present invention from the distal end of the neck 52 (the narrowed portion 50) is shorter than the length of the pipe 154 and the cap 156 of the comparative example by a distance D2. That is, the inlet pipe 18 of the muffler 10 according to the embodiment of the present invention is reduced in size and weight compared with the comparative example.

FIG. 5B is a cross-sectional view of the downstream end of the inlet pipe according to the known technology as the comparative example when the downstream end is viewed in a direction different from FIG. 4B. In this comparative example, the pipe 154 is provided with a plurality of punched holes 162 and attached to the distal end of the neck 150 (the narrowed portion 152) of the inlet pipe. As illustrated in FIG. 5A and 5B, the distance D1 between the inner wall W of the shell 16 and the first opening 66 of the cap 56 according to the embodiment of the present invention is larger than the shortest distance D3 between the inner wall W of the shell and the punched holes 162 of the pipe 154 according to the known technology. That is, the inner wall W of the shell 16 of the muffler 10 according to the embodiment of the present invention is prevented from being discolored (partially burnt) unlike the comparative example.

6. Modified Example

In the muffler 10 according to this embodiment, the first opening 66 faces in the direction maximizing the distance D1 from the inner wall W of the shell 16 opposite the first opening 66. However, the directions in which the openings 62 open are not limited to this example.

For example, the first opening 66 may face in a direction where the surface temperature of the outermost part of the shell 16 is less than or equal to a predetermined value based on the relationship between the attachment angle (the direction in which the first opening 66 opens) of the cap 56 and the surface temperature of the outermost part of the shell 16. This structure reliably prevents discoloration (partial burns) of the outermost part of the shell caused by the high temperature greater than or equal to a predetermined value due to the heat of the exhaust gas.

Figure 6:
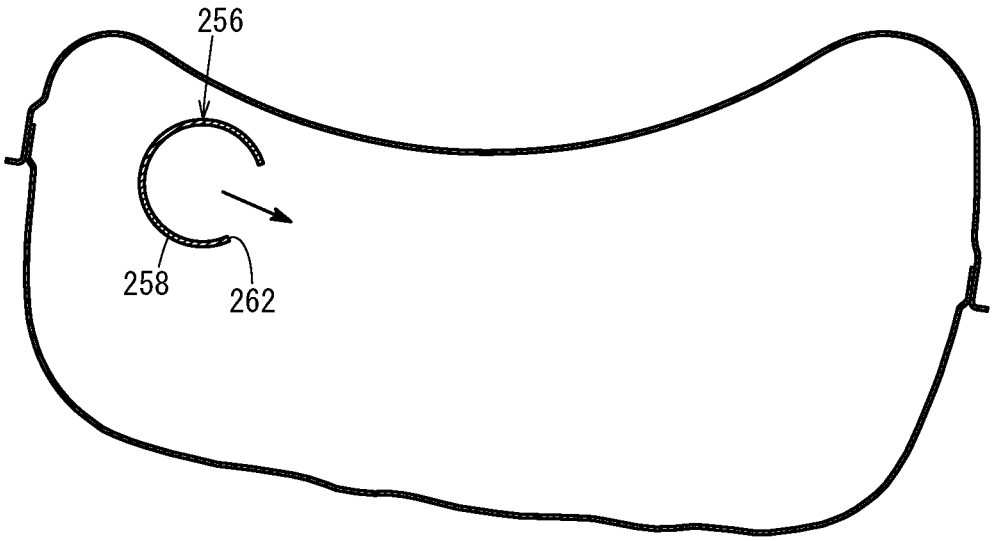
FIG. 6 is a cross-sectional view illustrating a modification of the cap.
Figure 7:
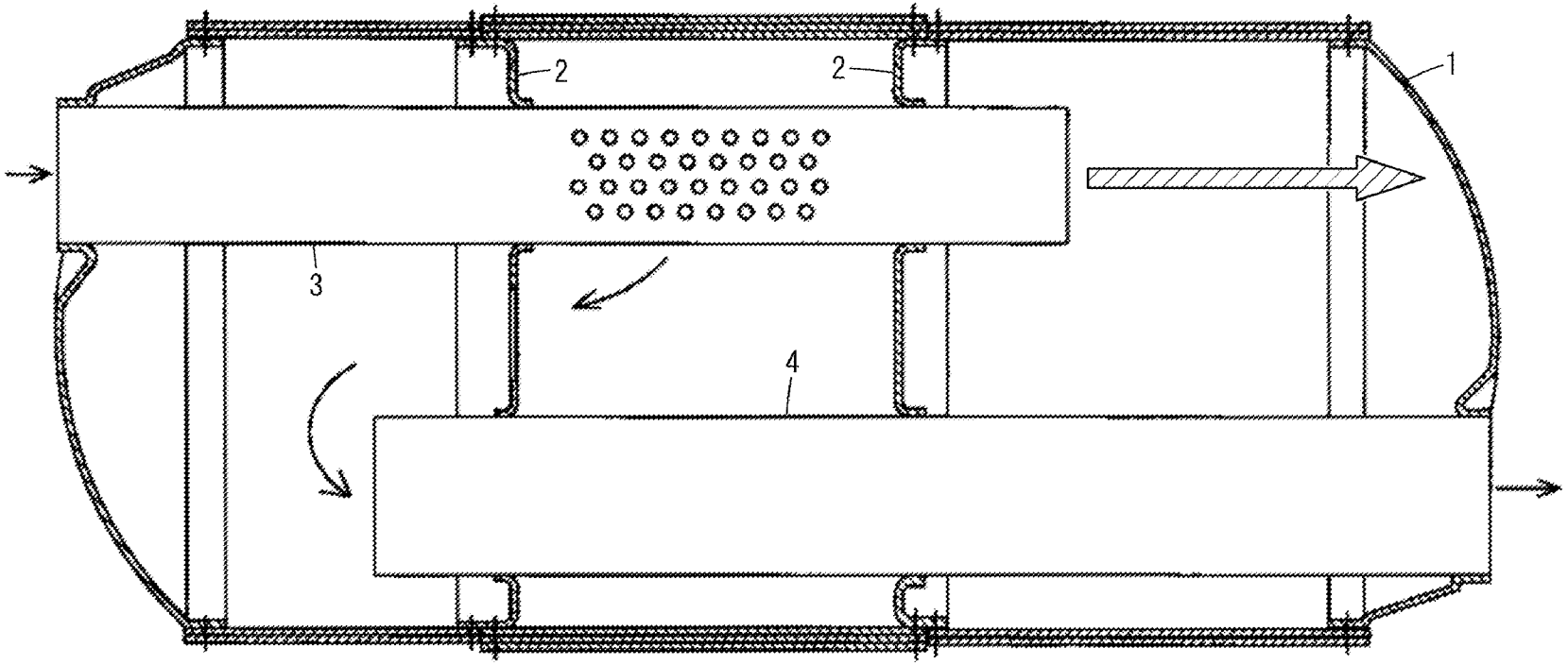
FIG. 7 PRIOR ART
FIG. 7 is a cross-sectional view of a muffler according to a known technology.
Figure 8:
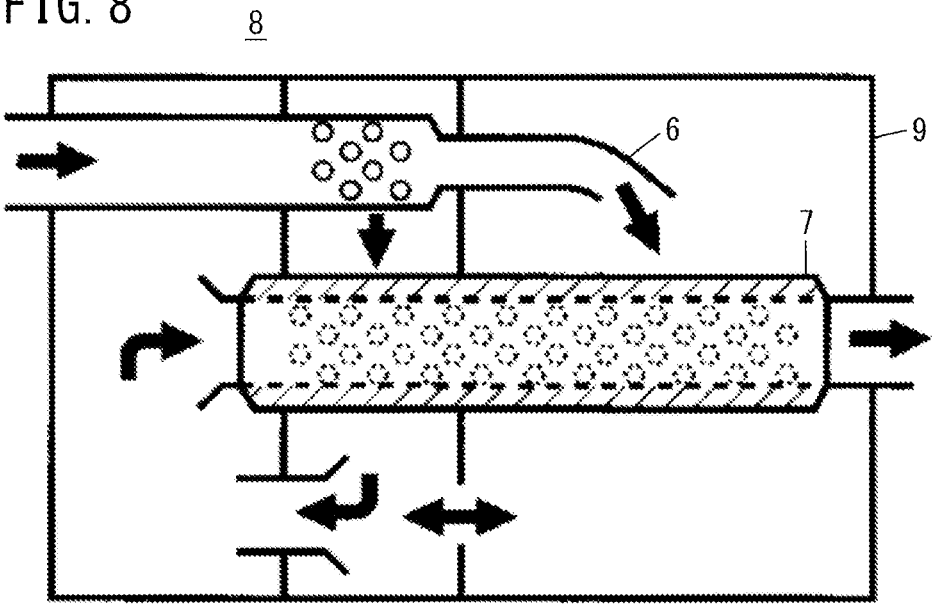
PRIOR ART FIG. 8
FIG. 8 is a cross-sectional view of another muffler according to a known technology.

In addition, the muffler 10 according to this embodiment includes the cap 56 provided with the two openings 62. However, the number of the openings is not limited to two. For example, as in a cap 256 illustrated in FIG. 6, a sidewall portion 258 may be provided with one opening 262.

Furthermore, in the muffler 10 according to this embodiment, the two openings 62 (the first opening 66 and the second opening 68) are arranged to be point-symmetric with respect to the axis of the cap 56 as the center of symmetry. However, the arrangement is not limited to this example. In other words, the central angle defined between a virtual line connecting the center of the first opening 66 and the axis of the cap 56 and a virtual line connecting the center of the second opening 68 and the axis of the cap 56 does not need to be 180°. The first opening 66 and the second opening 68 may be arranged to have the central angle of a predetermined value such as 120° or 90° according to the shape of the shell 16 and the installation position of the inlet pipe 18.

The muffler according to the present invention is not limited to the above-described embodiment, and various modifications and equivalents can be made without departing from the spirit and scope of the present invention as a

What is claimed is:

1. A muffler configured to be connected to an engine through an exhaust pipe, said muffler comprising:

a shell serving as a muffler body, the shell sectioned into a resonance chamber and an expansion chamber;

an inlet pipe configured to introduce exhaust gas from the engine into the shell; and an outlet pipe configured to discharge the exhaust gas out of the shell;

wherein the inlet pipe comprises:

a cylindrical portion positioned inside the expansion chamber and configured to be connected to the exhaust pipe; and a narrowed portion continuous from the cylindrical portion, the narrowed portion extending inside the resonance chamber and having a hollow truncated cone shape with a diameter gradually reduced toward a downstream side thereof, a downstream end of the narrowed portion having an exhaust outlet configured to introduce the exhaust gas into the resonance chamber, the muffler further comprising a cap covering the exhaust outlet of the inlet pipe and having a bottomed cylindrical shape coaxial with the exhaust outlet, wherein the cap is attached to a circumferential side surface of the inlet pipe's narrowed portion, and wherein a sidewall portion of the cap is provided with an opening, through which the exhaust gas flowing out of the inlet pipe's exhaust outlet passes, and which regulates a direction in which the exhaust gas flows out.

2. The muffler according to claim 1, wherein:

the cap includes:

a bottom wall portion configured to block a flow of the exhaust gas flowing out of the inlet pipe's exhaust outlet in an axial direction of the narrowed portion and guide, and wherein the bottom wall portion has a substantially flattened disk shape having a diameter larger than a diameter of the inlet pipe's exhaust outlet.

3. The muffler according to claim 1, wherein the sidewall portion of the cap includes a tapered portion, a diameter of which corresponds to an exterior shape of the downstream-side open end of the inlet pipe.

4. The muffler according to claim 1, wherein the opening of the cap faces in a direction that maximizes a distance from an inner wall of the shell opposite the opening.

5. The muffler according to claim 1, wherein the opening of the cap faces in a direction where a surface temperature of an outermost part of the shell is less than or equal to a predetermined value during vehicle operation, when the muffler is installed on a vehicle.

6. The muffler according to claim 1, wherein the cylindrical portion of the inlet pipe has a plurality of openings formed therein, and the narrowed portion does not have any openings formed therein other than the exhaust outlet.

7. The muffler according to claim 1, wherein the shell is sectioned into a resonance chamber and an expansion chamber by a separator having a plurality of openings formed therethrough.

8. The muffler according to claim 7, wherein the muffler is configured and arranged such that exhaust gas flowing out of the inlet pipe's exhaust outlet passes through the separator and then enters an inlet opening in an upstream end of the outlet pipe, where said outlet pipe inlet opening is disposed on an opposite side of the separator from the cap.

* * * * *